US005113662A

United States Patent [19]

Fujii et al.

[11] Patent Number: 5,113,662

[45] Date of Patent: May 19, 1992

[54] CRYOGENIC REFRIGERATOR

[75] Inventors: Nobuo Fujii; Hiroyuki Kiyota; Yoshihiro Katagishi; Takeshi Miyazawa, all of Kamakura, Japan

[73] Assignee: Mitsubishi Denki Kabushiki Kaisha, Tokyo, Japan

[21] Appl. No.: 664,817

[22] Filed: Mar. 5, 1991

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,224,187 | 12/1965 | Breihan | 62/6 |
| 4,372,127 | 2/1983 | Pohlmann et al. | 62/6 |
| 4,498,296 | 2/1985 | Dijkstra et al. | 62/6 |
| 4,500,265 | 2/1985 | Evans et al. | 62/6 |
| 4,811,563 | 3/1989 | Furuishi et al. | 60/520 |
| 4,822,390 | 4/1989 | Kazumoto et al. | 62/6 |
| 4,872,313 | 10/1989 | Kazumoto et al. | 62/6 |
| 4,888,951 | 12/1989 | Beale | 60/520 |

OTHER PUBLICATIONS

Walker: "Cryocoolers" New York, pp. 116-122.

Marsden, D.: "System Design Requirements for Infared Detector Cooling" Easton, MD 9/25-26/86.

Stolfi, F. R. et al.: "Parametric Testing of a Linearly Driven Stirling Cycle Refrigerator" Boulder Co. 9-1-7-84.

*Primary Examiner*—Ronald C. Capossela

*Attorney, Agent, or Firm*—Wolf, Greenfield & Sacks

[57] ABSTRACT

A refrigerator comprising a first cylinder and a second cylinder which are coaxially arranged, a first movable coil and a second movable coil which are oppositely arranged in a magnetic flux produced by a magnet, and which can be reciprocated by applying an a.c. current thereto; a first piston which is coupled to the first movable coil, and which can reciprocate in the first cylinder, a second piston which is coupled to the second movable coil, and which can reciprocate in the second cylinder; a compression space which is defined by the first cylinder, the second cylinder, the first piston and the second piston, a cold cylinder, a displacer which divides the inside of the cold cylinder into a cold space and a hot space, and which can slidably reciprocate in the cold cylinder, a regenerator which is arranged in the displacer; a partition wall which is arranged between the first cylinder and the second cylinder to divide the compression space into a first compression space and a second compression space, and communicating means for communicating between the first compression space and the second compression space.

4 Claims, 6 Drawing Sheets

CRYOGENIC REFRIGERATOR

BACKGROUND OF THE INVENTION

The present invention relates to a Stirling refrigerator which can cool e.g. an infrared sensor at temperatures as cryogenic as e.g. 80 K.

Referring now to FIG. 5, there is shown the structure of a conventional Stirling refrigerator.

In FIG. 5, the Stirling refrigerator is mainly constituted by a compressor 1, a cold finger 2 and a transfer pipe 3 connecting the compressor 1 and the cold finger 2. The compressor 1 includes a first cylinder 4*a*, a second cylinder 4*b*, a first piston 5*a* and a second piston 5*b*. Locating the first piston 5*a* and the second piston 5*b* is obtained by supporting springs 6*a* and 6*b*. The compressor has such a structure that the first piston 5*a* and the second piston 5*b* reciprocate in the first cylinder 4*a* and the second cylinder 4*b*, respectively.

To the first piston 5*a* and the second piston 5*b* are coupled a first sleeve 7*a* and a second sleeve 7*b*, respectively, which are made of non-magnetic, light-weight material. On the sleeves 7*a* and 7*b* are wound electric conductors, respectively, to form a first movable coil 8*a* and a second movable coil 8*b*. The movable coils 8*a* and 8*b* are connected to first lead wires 10*a* and 10*b*, and second lead wires 11*a* and 11*b* which extend outside through the wall of a housing 9. The lead wires 10*a*, 10*b*, 11*a* and 11*b* have first electric contacts 12*a* and 12*b*, and second electric contacts 13*a* and 13*b* which are outside of the housing 9. In the housing 9 are provided permanent magnets 14*a* and 14*b*, and yokes 15*a* and 15*b* which form closed magnetic circuits, respectively. The compressor has such a structure that the movable coils 8*a* and 8*b* can reciprocate in the axial election of the pistons 5*a* and 5*b* in a first gap 16*a* and a second gap 16*b*, respectively, the first gap 16*a* and the second gap 16*b* being formed in the closed magnetic circuits comprising he permanent magnets 14*a* and 14*b*, and the yokes 15*a* and 15*b*, respectively. In the gaps 16*a* and 16*b* are produced permanent magnetic fields in radius directions transverse to the moving direction of he movable coils 8*a* and 8*b*.

The internal space which is defined by the cylinders 4*a* and 4*b*, and the pistons 5*a* and 5*b* is called a compression space 17. The compression space 17 has working gas such as helium gas sealed in it under a higher pressure. In order to prevent the working gas in the compression space 17 from leaking through the gap between the cylinder 4*a* and the piston 5*a*, and through the gap between the cylinder 4*b* and the piston 5*b*, seals 28*a* and 28*b* are arranged in these gaps. This is the structure of the compressor 1.

On the other hand, the cold finger 2 includes a cylindrical cold cylinder 18, and a displacer 20 which is engaged with a resonant spring 19 and can slidably reciprocate in the cold cylinder 18. The internal space of the cold cylinder 18 is divided into two parts by the displacer 20. The upper space above the displacer 20 is called a cold space 21, and the lower space under the displacer 20 is called a hot space 22. In the displacer 20 are arranged a regenerator 23 and a gas passage hole 24. The cold space 21 and the hot space 22 are interconnected through the regenerator 23 and the gas passage hole 24. The regenerator 23 is filled with are generator matrix 25 such as a plurality copper wire mesh screens. In order to prevent a working gas from leaking through the gap between the cold cylinder 18 and the displacer 20, a seal 26 is arranged in the gap between the displacer 20 and the cold cylinder 18. The spaces of the cold finger 2 have the working gas such as helium gas sealed therein under a high pressure like the compressor 1. This is the structure of the cold finger 2. The compression space 17 of the compressor 1 is interconnected to the hot space 22 of the cold finger 2 though the transfer pipe 3. The compression space 17, the internal space in the transfer pipe 3, the cold space 21, the hot space 22, the regenerator 23 and the gas passage hole 24 are connected in series. They are called a working space 27 as a whole.

The operation of the conventional refrigerator thus constructed will be explained.

When an a.c. current is applied to the movable coils 8*a* and 8*b* through the electric contacts 12*a*, 12*b*, 13*a* and 13*b*, and the lead wires 10*a*, 10*b*, 11*a* and 11*b*, the movable coils 8*a* and 8*b* are subjected to a Lorentz force in the axial direction due to interaction of the magnetic fields in the gaps 16*a* and 16*b*, respectively. As a result, assemblies constituted by the pistons 5*a* and 5*b*, the sleeves 7*a* and 7*b*, and the movable coils 8*a* and 8*b* move horizontally in the axial direction of the pistons, respectively.

Suppose that the first movable coil 8*a* and the second movable coil 8*b* have the same properties, and that the strength of the magnetic field in the first gap 16*a* and that in the second gap 16*b* are equal to each other. When a sinusoidal current is applied to the first movable coil 8*a* and the second movable coil 8*b* to make them vibrate with the same amplitude in opposite directions, the pistons 5*a* and 5*b* reciprocate in the cylinders 4*a* and 4*b* in the opposite directions, giving sinusoidal undulation to the gas pressure in the working space 27 which extends from the compression space 17 to the cold space 21.

Changes in the flow rate of the gas passing through the displacer 20 and the regenerator 23 due to such sinusoidal undulation cause the displacer 20 including the regenerator 23 to axially reciprocate in the cold finger 2 at the same frequency as and out of phase with the pistons 5*a* and 5*b*.

When the pistons 5*a* and 5*b*, and the displacer 20 are moving keeping a suitable difference in phase, the working gas sealed in the working space 27 performs a thermodynamic cycle known as the "Inverse Stirling Cycle", and generates cold production mainly in the cold space 21. The "Stirling Cycle" and the principle of generation of the cold production thereby are described in detail in "Cryocoolers" (G. Walker, Plenum Press, New York, 1983, PP 117-123). The principle will be described briefly. The working gas in the compression space 17 which has been compressed by the pistons 5*a* and 5*b* to be heated is cooled while flowing through the transfer pipe 3. The gas thus cooled flows into the hot space 22, the regenerator 23 and the gas passage hole 24. The gas is precooled in the regenerator 23 by the cold production which has been accumulated in a preceding half cycle, and then enters the cold space 21. When most of the working gas has entered the cold space 21, expansion starts to generate cold production in the cold space 21. After that, the working gas returns through the same route in the reverse order, passing the cold production to the regenerator 23, and enters the compression chamber 17. At that time, heat is removed from the leading portion of the cold finger 2, causing the surroundings outside the leading portion to be cooled.

When most of the working gas has returned to the compression chamber 17, compression restarts, and the next cycle commences. The process as described above is repeated to complete the "Inverse Stirling Cycle", causing cold production to generate.

The conventional refrigerator involves the problem as described below. Because locating the assemblies constituted by the pistons, the movable coils and the sleeves is obtained by the supporting springs, the respective assemblies constitute a spring-mass vibration system having one degree of freedom. Referring now to FIG. 6, there is shown a model diagram of the spring-mass vibration system. In FIG. 6, symbol m designates the mass of each assembly which comprises the piston, the movable coil and the sleeve. Symbol k designates the spring constant of each supporting spring. Symbol $f_O$ designates the resonance frequency of the vibration system. The symbol $f_O$ is defined by the following equation, using the symbols m and k:

$$f_0 = \frac{1}{2\pi} \cdot \sqrt{\frac{k}{m}} \quad (1)$$

Suppose that the conventional refrigerator is arranged at such environment that it is subjected to vibration from outside in the case of e.g. an air craft or a vehicle. When vibration having a component of $f=f_O$ in the axial direction of the pistons is applied to the conventional refrigerator, the assemblies which comprise the pistons, the movable coils and the sleeves resonate, so that the assembly of the first piston, the first movable coil and the first sleeve, the assembly of the second piston, the second movable coil and the second sleeve, and the working gas in the compression space vibrate with the same cycle and with the same phase as one unit as shown in FIG. 6. Since no vibration damping effect due to the working gas in the compression space is involved in such resonance, resonant magnification is great to obtain vibration having wide amplitude.

This creates a problem in that when the vibration which is applied from outside grows greater, the vibrating pistons, the vibrating movable coils and the vibrating sleeves can collide against the housing or the yokes to make a noise or damage a part.

It is an object of the present invention to resolve the problem and to provide a cryogenic refrigerator capable of damping resonance without making a noise and damaging a part.

SUMMARY OF THE INVENTION

The foregoing and other objects have been attained by providing a refrigerator comprising a first cylinder and a second cylinder which are coaxially arranged: a first movable coil and a second movable coil which are oppositely arranged in a magnetic flux produced by a magnet, and which can be reciprocated by applying an a.c. current thereto; a first piston which is coupled to the first movable coil, and which can reciprocate in the first cylinder; a second piston which is coupled to the second movable coil, and which can reciprocate in the second cylinder; a compression space which is defined by the first cylinder, the second cylinder, the first piston and the second piston; a cold cylinder; a displacer which divides the inside of the cold cylinder into a cold space and a hot space, and which can slidably reciprocate in the cold cylinder; a regenerator which is arranged in the displacer; a partition wall which is arranged between the first cylinder and the second cylinder to divide the compression space into a first compression space and a second compression space; and communicating means for communicating between the first compression space and the second compression space.

In a preferred embodiment, the communicating means comprises a communicating pipe which communicates between the first compression space and the second compression space.

In a preferred embodiment, the communicating pipe is connected to a transfer pipe which extends from the cold cylinder.

In a preferred embodiment, the communicating means comprises an orifice which is formed in the partition wall.

In accordance with the present invention, the presence of the communicating means can produce resistance to damp the vibration of a spring-mass system which is constituted by the pistons and the movable coils. The present invention can prevent the pistons and cylinders from colliding against a housing or a yoke to eliminate the generation of noise and damage to, a part.

DESCRIPTION OF PREFERRED EMBODIMENTS

Now, the present invention will be described in detail with reference to preferred embodiments illustrated in the accompanying drawings.

Figure 1:
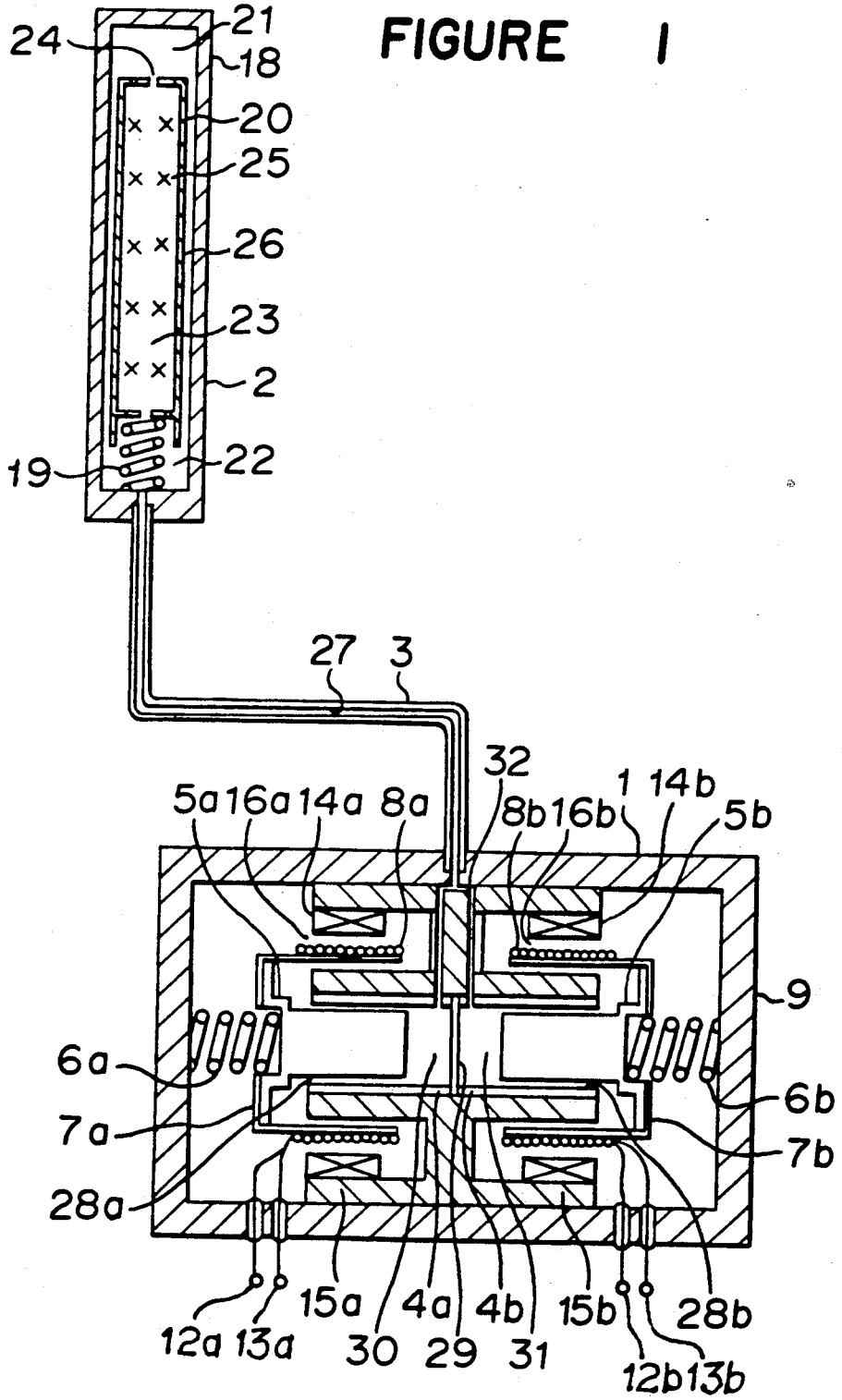
FIG. 1 is a cross sectional view of a first embodiment of the cryogenic refrigerator according to the present invention.

Referring now to FIG. 1, there is shown a first embodiment of the present invention. The parts indicated by reference numerals 1–16, and 18–28 are the same as those of the conventional cryogenic refrigerator. Detailed explanation of those parts will be omitted for the sake of simplicity. Between a first cylinder **4*a* and a second cylinder 4*b* is provided a partition wall 29. The space which is defined by the first cylinder 4*a*, a first piston 5*a* and the partition wall 29 is called a first compression space 30, and the space which is defined by the second cylinder 4*b*, a second piston 5*b* and the partition wall 29 is called a second compression space 31. The first compression space 30 and the second compression space 31 is interconnected together through a communicating pipe 32. A transfer pipe 3 is connected to the communicating pipe 32 to communicate between the first compression space 30 and the second compression space 31 in a compressor 1, and a hot space 22 in a cold finger 2**.

Figure 2:
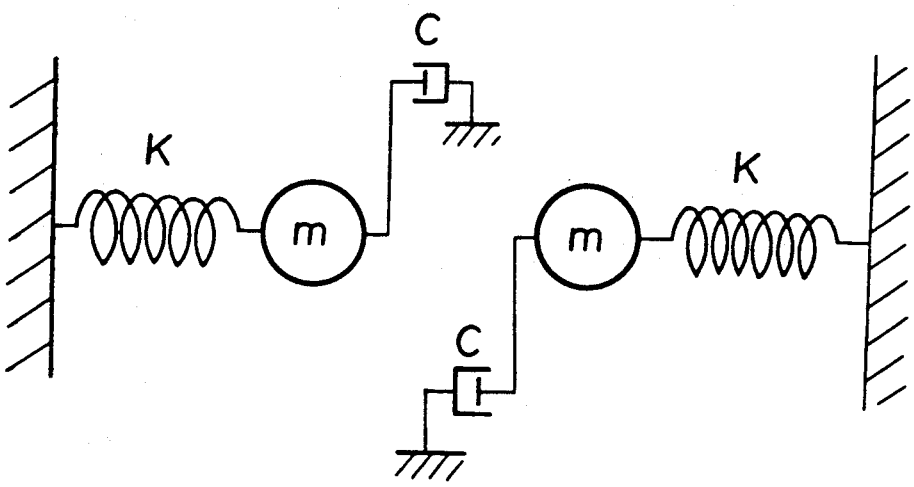
FIG. 2 is a diagram showing the vibration damping model in the first embodiment.

The refrigerator having such structure is a spring-mass vibration system having one degree of freedom which is constituted by the pistons **5*a* and 5*b***, movable coils 8*a* and 8*b*, sleeves 7*a* and 7*b*, and supporting springs 6*a* and 6*b*. When vibration which includes the frequency component equal to the resonant frequency of such spring-mass vibration system is applied to the refrigerator in the axial direction of the pistons 5*a* and 5*b* from outside, an assembly comprising the first piston 5*a*, the first movable coil 8*a* and the first sleeve 7*a*, and an assembly comprising the second piston 5*b*, the second movable coil 8*b* and the second sleeve 7*b* are vibrated in the same axial direction, causing a working gas to move through the communicating pipe 32 between the first compression space 30 and the second compression space 31. At that time, the working gas is subjected to pipe friction resistance due to the communicating pipe 32 and resistance due to the bent of flow. These resistances work as a vibration damping force to lower resonant magnification. Referring now to FIG. 2, there is shown a schematic vibration model diagram showing this vibration damping mechanism. In FIG. 2, symbol m designates the mass for the assembly of the first piston, the first movable coil and the first sleeve, and the assembly of the second piston, the second movable coil and the second sleeve. Symbol k designates a spring constant for the first supporting spring and the second supporting spring. Symbol c designates a damping efficient due to the vibration damping force stated earlier. This vibration damping mechanism will be described in detail in reference to the structure of the embodiment. The pipe friction resistance, and the resistance due to the bent of flow produce a pressure difference between the first compression space 30 and the second compression space 31, and the pressure difference is invariably applied in such direction that the movement of the assemblies of the pistons 5*a* and 5*b*, the movable coils 8*a* and 8*b*, and the sleeves 7*a* and 7*b* is restrained. As a result, the vibration can be damped. This arrangement can prevent the pistons 5*a* and 5*b*, the movable coils 8*a* and 8*b*, the sleeves 7*a* and 7*b* from colliding against the housing 9 or the yokes 15*a* and 15*b*, thereby allowing the generation of noise and the damage of a part to be eliminated.

On the other hand, under an ordinary operation, i.e., in the course wherein the working gas reciprocates between the first and second compression spaces 30 and 31, and the hot space 22, the pipe friction resistance is smaller than the just described case by reduction of the passage, and there is no bent of the flow. As a result, the resistance which the working gas is given by the communicating pipe 32 is not different from the conventional refrigerator, and no performance deteriorates.

Figure 3:
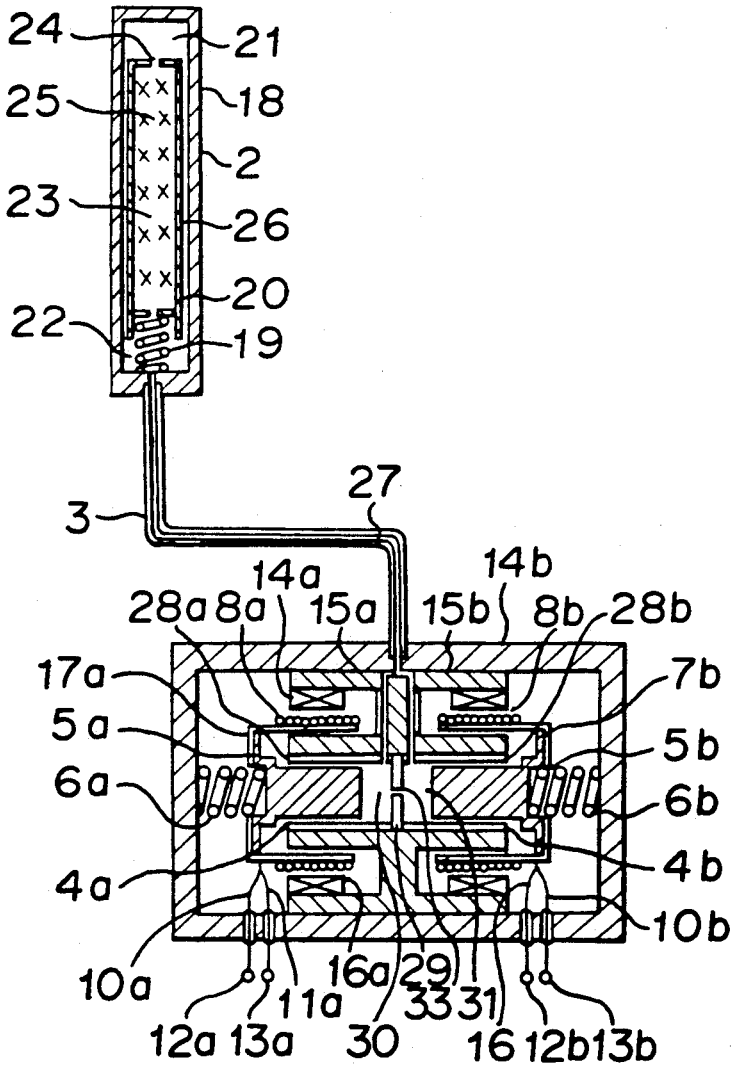
FIG. 3 is a cross sectional view of a second embodiment of the cryogenic refrigerator according to the present invention.

Referring now to FIG. 3, there is shown a second embodiment of the present invention. The second embodiment is different from the first embodiment in that the partition wall 29 has an orifice 33 formed therein, and that the first compression space 30 and the second compression space 31 are interconnected together through the orifice 33.

Figure 4:
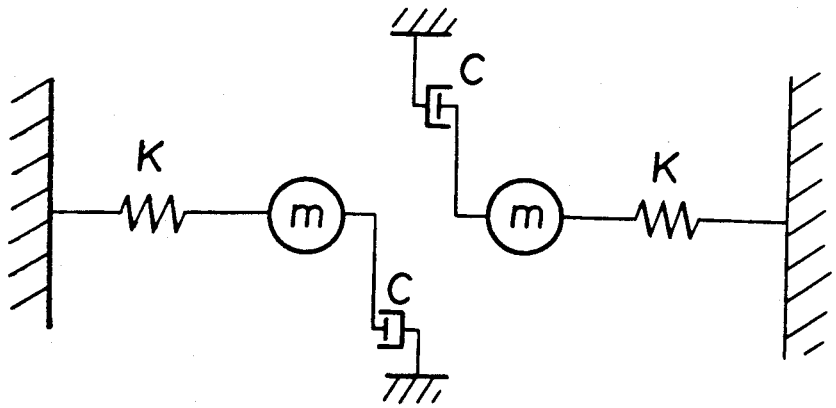
FIG. 4 is a diagram showing the vibration damping model in the second embodiment.
Figure 5:
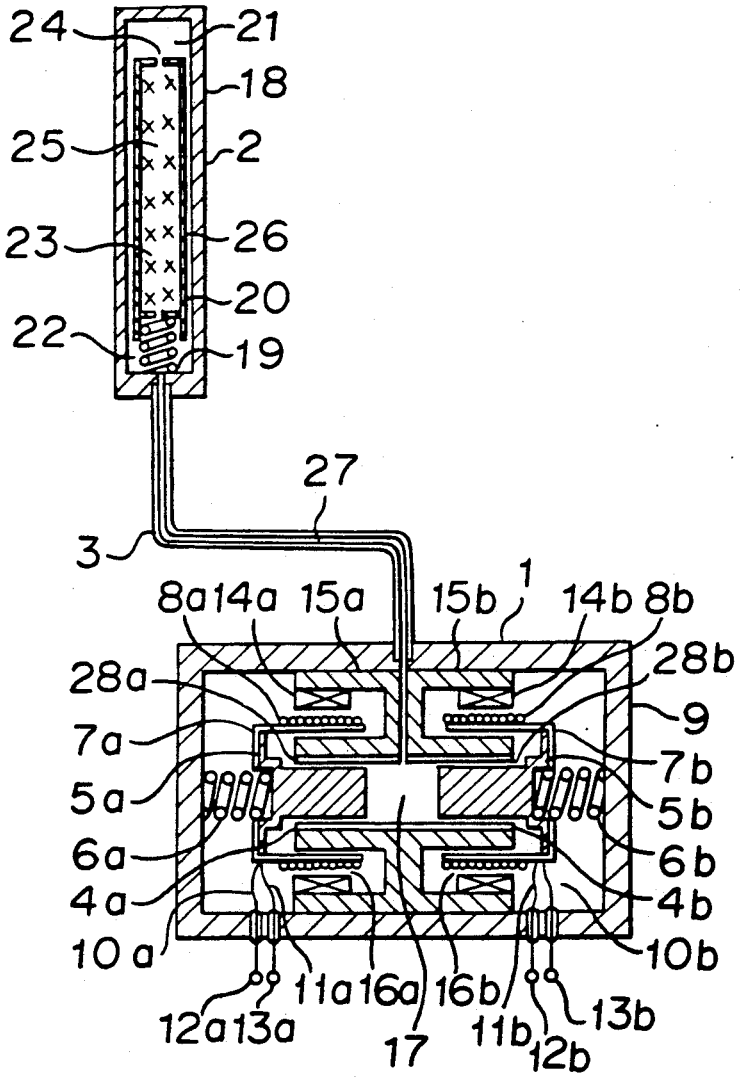
FIG. 5 is cross sectional view of a conventional cryogenic refrigerator.
Figure 6:
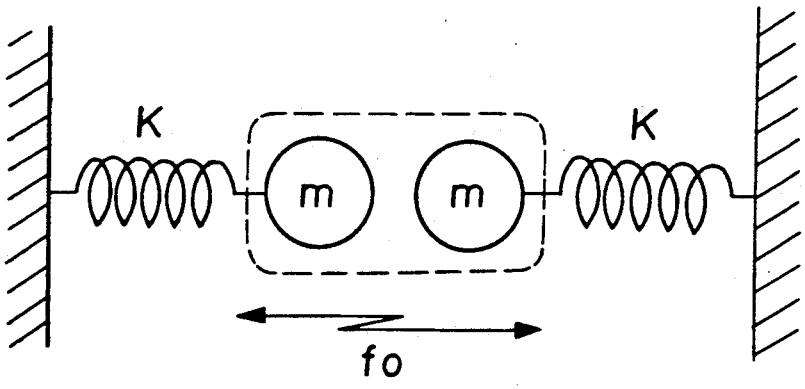
FIG. 6 is a diagram showing the vibration model of a spring-mass system which is constituted by pistons, movable coils, sleeves and supporting springs.

In the second embodiment, when vibration which includes the frequency component equal to a resonant frequency of the spring-mass vibration system having one degree of freedom constituted by the pistons 5*a* and 5*b*, the movable coils 8*a* and 8*b*, the sleeves 7*a* and 7*b*, and the supporting springs 6*a* and 6*b* is applied in the axial direction of the pistons 5*a* and 5*b* from outside, the working gas moves through the orifice 33 which is formed in the partition wall 29 between the first compression space 30 and the second compression space 31. At that time, the working gas is given resistance by the orifice 33, and the resistance can work as a vibration damping force to lower resonant magnification. The resistance caused by the orifice 33 produces a pressure difference between the first compression space 30 and the second compression space 31. The pressure difference can damp vibration because the pressure difference is invariably applied in such direction that the movement of the assemblies of the pistons 5*a* and 5*b*, the movable coils 8*a* and 8*b*, and the sleeves 7*a* and 7*b* is restrained. Referring now to FIG. 4, there is shown a vibration model diagram of the vibration damping mechanism of the second embodiment.

On the other hand, under an ordinary operation, i.e., in the course wherein the working gas reciprocates between the compression spaces 30 and 31, and the hot space 22, the pistons move at the same phase and the same amplitude, and the pressure in the first compression space 30 and that in the second compression space 31 become totally equal. In this manner, no pressure difference is caused across the opposite end surfaces of the orifice 30, and the working gas is given no resistance from the orifice 30, preventing performance from lowering.

Although the explanation on the embodiments as stated earlier has been made for a split-Stirling refrigerator wherein the compressor 1 and the cold finger 2 are separated through the transfer pipe 3, the present invention is also applicable to an integral Stirling refrigerator wherein the compressor 1 and the cold finger 2 are mechanically combined firmly. The present invention can give the integral Stirling refrigerator advantage similar to the embodiments.

What is claimed is:

1. A refrigerator comprising:
- a first cylinder and a second cylinder which are coaxially arranged;
- a first movable coil and a second movable coil which are oppositely arranged in a magnetic flux produced by a magnet, and which can be reciprocated by applying an a.c. current thereto;
- a first piston which is coupled to the first movable coil, and which can reciprocate in the first cylinder;
- a second piston which is coupled to the second movable coil, and which can reciprocate in the second cylinder;
- a compression space which is defined by the first cylinder, the second cylinder, the first piston and the second piston;
- a cold cylinder;
- a displacer which divides the inside of the cold cylinder into a cold space and a hot space, and which can slidably reciprocate in the cold cylinder;
- a regenerator which is arranged in the displacer; a partition wall which is arranged between the first cylinder and the second cylinder to divide the second compression space; and
- communicating means for communicating between the first compression space and the second compression space.

2. A refrigerator according to claim 1, wherein the communicating means comprises a communicating pipe which communicates between the first compression space and the second compression space.

3. A refrigerator according to claim 2, wherein the communicating pipe is connected to a transfer pipe which extends from the cold cylinder.

4. A refrigerator according to claim 1, wherein the communicating means comprises an orifice which is formed in the partition wall.

* * * * *